US009482231B2

(12) United States Patent
Oyagi et al.

(10) Patent No.: US 9,482,231 B2
(45) Date of Patent: Nov. 1, 2016

(54) ROTARY COMPRESSOR HAVING AN OIL GROOVE IN AN INNER PERIPHERAL SURFACE OF A BEARING

(71) Applicant: PANASONIC INTELLECTUAL PROPERTY MANAGEMENT CO., LTD., Osaka-shi, Osaka (JP)

(72) Inventors: Shingo Oyagi, Kyoto (JP); Hirofumi Yoshida, Shiga (JP); Hiroaki Nakai, Shiga (JP); Yu Shiotani, Osaka (JP); Ryuichi Ohno, Shiga (JP); Tsuyoshi Karino, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 17 days.

(21) Appl. No.: 14/410,951

(22) PCT Filed: Oct. 22, 2013

(86) PCT No.: PCT/JP2013/006229

§ 371 (c)(1),
(2) Date: Dec. 23, 2014

(87) PCT Pub. No.: WO2014/064919

PCT Pub. Date: May 1, 2014

(65) Prior Publication Data

US 2015/0322949 A1 Nov. 12, 2015

(30) Foreign Application Priority Data

Oct. 23, 2012 (JP) ..... 2012-233399

(51) Int. Cl.
*F03C 2/00* (2006.01)
*F03C 4/00* (2006.01)
(Continued)

(52) U.S. Cl.
CPC ..... *F04C 29/02* (2013.01); *F04B 39/02* (2013.01); *F04C 18/322* (2013.01);
(Continued)

(58) Field of Classification Search
CPC .. F04C 23/008; F04C 18/322; F04C 18/356; F04C 27/001; F04C 29/00; F04C 29/02; F04C 29/026; F04C 2240/50; F04C 18/3564; F04C 29/028; F04C 2210/268; F04B 39/02
USPC ..... 418/11, 60, 88, 94, 243, 248, 63, 98
See application file for complete search history.

(56) References Cited

U.S. PATENT DOCUMENTS 5,667,372 A 9/1997 Hwang et al.
2005/0053506 A1 3/2005 Cho et al.

FOREIGN PATENT DOCUMENTS

CN 1116690 2/1996
CN 1186872 7/1998
(Continued)

OTHER PUBLICATIONS

Supplementary European Search Report issued in corresponding European patent application, dated Nov. 30, 2015, 8 pages total.
(Continued)

*Primary Examiner* — Theresa Trieu
(74) *Attorney, Agent, or Firm* — Hamre, Schumann, Mueller & Larson, P.C.

(57) ABSTRACT

A compression element includes a substantially spiral oil groove which is provided in inner peripheral surfaces of bearings and of the shaft. One end of the oil groove opens at a bearing base portion, and the other end of the oil groove opens at a bearing end. According to this configuration, oil in a gap between the shaft and inner peripheries of the bearings and forcibly discharges, into the hermetic container, gas bubbles generated in a sliding gap between the shaft and the bearings and by action of a viscosity pump generated by the substantially spiral oil groove, and it is possible to provide a rotary compressor capable of preventing seizing and wearing caused by gas-involvement at a bearing sliding portion, and capable of securing reliability when refrigerant including R32 is used.

3 Claims, 7 Drawing Sheets

(51) Int. Cl.

| | |
|---|---|
| ***F04C 2/00*** | (2006.01) |
| ***F04C 15/00*** | (2006.01) |
| ***F04C 29/02*** | (2006.01) |
| ***F04C 18/32*** | (2006.01) |
| ***F04C 27/00*** | (2006.01) |
| ***F04B 39/02*** | (2006.01) |
| ***F04C 29/00*** | (2006.01) |
| ***F04C 18/356*** | (2006.01) |
| *F04C 23/00* | (2006.01) |

(52) U.S. Cl.

CPC ..... *F04C 18/3564* (2013.01); *F04C 27/001* (2013.01); *F04C 29/00* (2013.01); *F04C 29/028* (2013.01); *F04C 23/008* (2013.01); *F04C 2210/268* (2013.01); *F04C 2240/50* (2013.01)

(56) References Cited

FOREIGN PATENT DOCUMENTS

| | | |
|---|---|---|
| EP | 0715079 | 6/1996 |
| JP | 60-135685 | 7/1985 |
| JP | 63-248994 | 10/1988 |
| JP | 05-157087 | 6/1993 |
| JP | 10-115296 | 5/1998 |
| JP | 2001-295762 | 10/2001 |
| JP | 2007-315261 | 12/2007 |
| JP | 2009-108747 | 5/2009 |
| JP | 2009-167830 | 7/2009 |
| JP | 2010-255448 | 11/2010 |
| JP | 2010-255449 | 11/2010 |

OTHER PUBLICATIONS

Office action issued Aug. 26, 2015 in corresponding Chinese patent application and English translation thereof, 5 pages total.

Search Report dated Jul. 24, 2015 from corresponding Chinese patent application and English translation thereof, 4 pages total.

ROTARY COMPRESSOR HAVING AN OIL GROOVE IN AN INNER PERIPHERAL SURFACE OF A BEARING

TECHNICAL FIELD

The present invention relates to a rotary compressor using refrigerant including R32.

BACKGROUND TECHNIQUE

In a heat pump type refrigerating appliance which is widely used in an electric appliance such as an air conditioner, a heater and a water heater, HCFC-based refrigerant is conventionally used as refrigerant. However, the HCFC-based refrigerant having large ozone depletion potential is subject to CFCs control. Therefore, R410A (R32:R125=50:50) refrigerant which is HFC-based refrigerant having zero ozone depletion potential is generally used as alternative refrigerant of the HCFC-based refrigerant.

Under these circumstances, efforts are underway to arrest global warming on a world scale. Refrigerant makers, oil makers and air conditioner makers work toward further reduction and improvement of global warming potential (GWP), and work in research and development of new safe refrigerant and oil for new refrigerant.

Working toward such improvement, among the HFC-based refrigerants, R32 refrigerant is a next candidate refrigerant, and a compressor using the R32 refrigerant is proposed (see patent document 1 for example). The GWP of the R32 refrigerant is lower than that of R410A refrigerant, and COP (coefficient of performance) of the R32 refrigerant bears comparison with conventional refrigerants.

PRIOR ART DOCUMENT

Patent Document

[Patent Document 1] Japanese Patent Application Laid-open No. 2001-295762

SUMMARY OF THE INVENTION

Problem to be Solved by the Invention

The R32 refrigerant has a feature that a GWP value thereof is low, but a boiling point of the R32 refrigerant is lower than that of the currently used R410A refrigerant. Hence, oil solubility degree of refrigerant is lowered. If the solubility degree is lowered, there is fear that refrigerant which is separated from oil is supplied to a compressor sliding portion when a compressor is operated, and there is fear that sliding-resistant characteristics are deteriorated due to gas-involvement and reliability of the compressor is deteriorated.

Here, one example of a conventional rotary compressor will be described. FIG. 6 is a vertical sectional view of the conventional rotary compressor described in patent document 1, and FIG. 7 is a sectional view of a compression element of the conventional rotary compressor. An electric element 104 composed of stators 102 and a rotor 103, and a compression element 105 which is driven by the electric element 104 are accommodated in a hermetic container 101. Oil 106 is stored in a bottom of the hermetic container 101. As shown in FIG. 7, a shaft 107 includes an eccentric portion 108.

A cylinder 109 forms a compression chamber concentrically with a rotation center of the shaft 107. A main bearing 110 and an auxiliary bearing 111 hermetically close both side surfaces of the cylinder 109. A piston 112 is mounted on an eccentric portion 108, and rolls along an inner wall of the compression chamber. A vane (not shown) is in contact with the piston 112 and reciprocates. The compression chamber is partitioned by the vane into a high pressure chamber and a low pressure chamber. One end of a suction pipe 113 is press-fitted into the cylinder 109, and opens into the low pressure chamber of the compression chamber, and the other end of the suction pipe 113 is connected to a low pressure side of a system (not shown) outside the hermetic container 101. The main bearing 110 is provided with a discharge valve (not shown). A discharge muffler 114 having an opening is fitted into the main bearing 110. One end of a discharge pipe 115 opens into a space in the hermetic container 101, and the other end of the discharge pipe 115 is connected to a high pressure side of the system (not shown). An oil-feeding hole 116 is formed in the shaft 107 in its axial direction, and an oil panel 117 is accommodated in the oil-feeding hole 116. The oil-feeding hole 116 is in communication, through a communication hole 118, with a space formed by the eccentric portion 108 of the shaft 107 and the piston 112.

In the above-described configuration, rotation of the rotor 103 is transmitted to the shaft 107, and the piston 112 fitted into the eccentric portion 108 rolls in the compression chamber. The vane which abuts against the piston 112 partitions the compression chamber into the high pressure chamber and the low pressure chamber, thereby continuously compressing gas sucked by the suction pipe 113. The compressed gas is discharged into the discharge muffler 114 from the discharge valve (not shown), opened into the space in the hermetic container 101 and discharged from the discharge pipe 115.

Next, a flow of the oil 106 will be described. With rotation of the shaft 107, the oil panel 117 accommodated in the oil-feeding hole 116 sucks the oil 106. The sucked oil 106 is supplied to sliding portions of the eccentric portion 108 and an inner periphery of the piston 112 through the communication hole 118. The oil 106 which lubricated the sliding portions stays in a space surrounded by the inner periphery of the piston 112 and a bearing end surface. Thereafter, the oil 106 which stays in the space is sucked into the cylinder 109 from an end surface of the piston 112, supplied to the compression chamber, lubricates sliding portions of the piston 112 and a vane, and seals the compression chamber. Refrigerant filled in the system dissolves in the oil 106 which lubricates the compressor, and a solubility degree of refrigerant is lowered as its temperature is raised.

If the compressor which is in a halting state starts operating and a temperature of a compressing mechanism is raised, the oil 106 sucked into the compressing mechanism is heated, the solubility degree of refrigerant is lowered, refrigerant is deposited in its gaseous state and becomes air bubbles. Around the sliding portions and an oil groove where gas bubbles are less prone to be discharged, a flow of the oil 106 is blocked with the gas bubbles, there is a possibility that the oil 106 does not flow, and lubrication failure occurs, a bearing sliding portion seizes or wears. In the case of the R32 refrigerant, a boiling point is low and as a temperature thereof is raised, the solubility degree of refrigerant is largely lowered. Therefore, an amount of generated gas bubbles is larger as compared with the R410a refrigerant, and there is a serious problem that reliability of the bearing is deteriorated.

It is an object of the present invention to provide a rotary compressor capable of excellently supplying oil without being hindered by gas bubbles even if a boiling point of refrigerant is low, and capable of preventing a bearing sliding portion from seizing or wearing.

Means for Solving the Problem

That is, the present invention provides a rotary compressor, comprising: a hermetic container storing oil and having a compression element, the compressor using refrigerant including R32, the compression element including: a shaft having an eccentric portion; a cylinder forming a compression chamber concentrically with a rotation center of the shaft; a bearing which hermetically closes both side surfaces of the cylinder and which pivotally supports the shaft; a piston which is mounted on the eccentric portion and which rolls along an inner wall of the cylinder by rotation of the shaft; and a vane which comes into contact with an outer periphery of the piston and which partitions the compression chamber into a high pressure chamber and a low pressure chamber, wherein a substantially spiral oil groove is provided in an inner peripheral surface of the bearing, one end of the oil groove opens at a bearing base portion which is on a side of the compression chamber, and an other end of the oil groove opens at a bearing end which is on a side of a space in the hermetic container, and gas bubbles of the refrigerant are discharged into the hermetic container through the oil groove.

According to this configuration, oil existing in a gap between the shaft and an inner periphery of the bearing is discharged into the hermetic container by action of a viscosity pump generated by the substantially spiral oil groove. Therefore, gas bubbles generated in a sliding gap between the shaft and the bearing are forcibly discharged into the hermetic container together with the oil and thus, it is possible to prevent seizing and wearing caused by gas-involvement at the bearing sliding portion.

Effect of the Invention

According to the rotary compressor of the present invention, gas bubbles generated in the sliding gap between the shaft and the bearing are forcibly discharged into the hermetic container, and it is possible to prevent seizing and wearing caused by gas-involvement at the bearing sliding portion. Therefore, even if refrigerant having a low boiling point and which is easily gasified when the refrigerant is dissolved in oil is used, it is possible to secure excellent reliability.

EXPLANATION OF SYMBOLS

Figure 1:
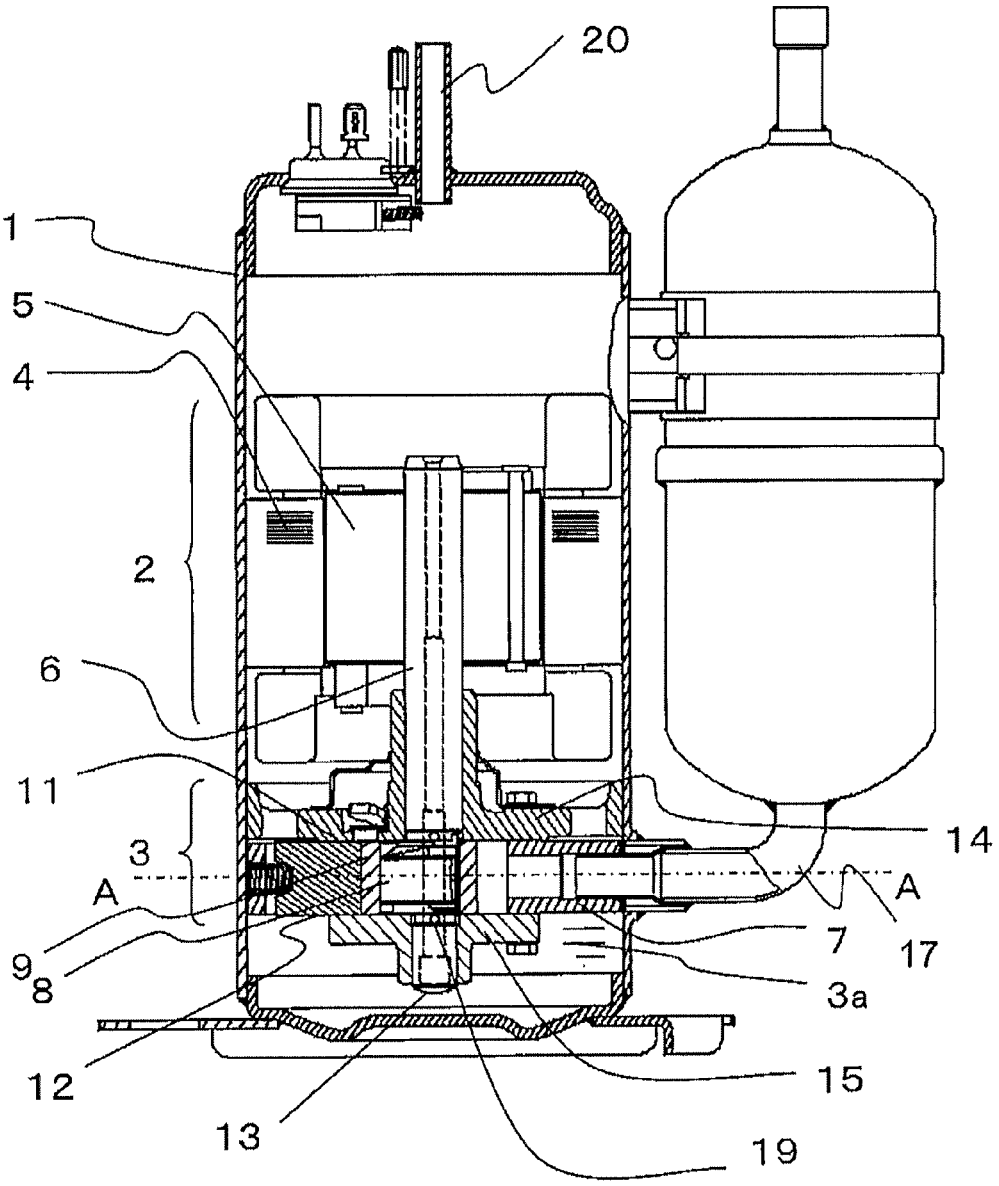
FIG. 1 is a vertical sectional view of a rotary compressor according to a first embodiment of the present invention.

1 hermetic container
2 electric element
3 compression element
3*a* oil reservoir
4 stator
5 rotor
6 shaft
7 cylinder
8 eccentric portion
9 piston
10 vane
11 upper end surface
12 lower end surface
13 oil-feeding hole
14 main bearing
15 auxiliary bearing
16 compression chamber
17 suction pipe
18 discharge hole
19 communication hole
20 discharge pipe
23, 23*a*, 23*b* oil groove
24 bearing base portion
25 bearing end

MODE FOR CARRYING OUT THE INVENTION

A first aspect of the invention provides a rotary compressor, comprising: a hermetic container storing oil and having a compression element, the compressor using refrigerant including R32, the compression element including: a shaft having an eccentric portion; a cylinder forming a compression chamber concentrically with a rotation center of the shaft; a bearing which hermetically closes both side surfaces of the cylinder and which pivotally supports the shaft; a piston which is mounted on the eccentric portion and which rolls along an inner wall of the cylinder by rotation of the shaft; and a vane which comes into contact with an outer periphery of the piston and which partitions the compression chamber into a high pressure chamber and a low pressure chamber, wherein a substantially spiral oil groove is provided in an inner peripheral surface of the bearing, one end of the oil groove opens at a bearing base portion which is on a side of the compression chamber, and an other end of the oil groove opens at a bearing end which is on a side of a space in the hermetic container, and gas bubbles of the refrigerant are discharged into the hermetic container through the oil groove.

According to this aspect, oil existing in a gap between the shaft and an inner periphery of the bearing is discharged into the hermetic container by action of a viscosity pump generated by the substantially spiral oil groove. Therefore, gas bubbles generated in a sliding gap between the shaft and the bearing are forcibly discharged into the hermetic container together with the oil and thus, it is possible to prevent seizing and wearing caused by gas-involvement at the bearing sliding portion.

According to a second aspect of the invention, in the first aspect, in the substantially spiral oil groove, an opening of the bearing end is located closer to a rotation direction of the shaft than an opening of the bearing base portion.

According to this aspect, since gas generated from oil can reliably be discharged from the compression element portion into the hermetic container, it is possible to prevent gas from flowing toward the sliding portion of the compression element portion, and to provide a rotary compressor having enhanced reliability.

According to a third aspect of the invention, in the first or second aspect, the bearing comprises a main bearing which closes an upper surface side of the cylinder, and an auxiliary bearing which closes a lower surface side of the cylinder, and the oil groove is provided in at least one of the main bearing and the auxiliary bearing.

According to this aspect, gas bubbles generated around at least one of sliding portions of both the bearings can forcibly be discharged into the hermetic container, and it is possible to reliably prevent gas-involvement at the bearing sliding portion.

According to a fourth aspect of the invention, in the third aspect, the rotary compressor further includes one more oil groove, the oil grooves are provided in both of the main bearing and the auxiliary bearing, respectively, and a width of the oil groove provided in the auxiliary bearing is wider than a width of the oil groove provided in the main bearing.

According to this aspect, it becomes easy to discharge gas bubbles generated at the sliding portion of the auxiliary bearing which is located lower than the cylinder, and it is possible to efficiently suppress gas-involvement at the auxiliary bearing, and to secure higher reliability. That is, refrigerant gas has density which is lower than that of oil, and has low viscosity. Therefore, the refrigerant gas flows from the compression element portion upward in the vertical direction of a center axis of the shaft and thus, inconvenience such as gas-involvement is not easily generated at the main bearing. On the other hand, since the auxiliary bearing is soaked in the oil reservoir, gas generated from the compression element portion does not easily flow toward the hermetic container, and gas-involvement is prone to be generated. According to this configuration, it is possible to suppress gas-involvement at the auxiliary bearing where gas-involvement is easily generated, and it is possible to secure a flow of oil. Therefore, high reliability can be secured.

According to a fifth aspect of the invention, in any one of the first to third aspects, the oil groove is provided in a bearing surface on a side opposite from an acting direction of a bearing load.

According to this aspect, since a region of the bearing surface having a small load is provided with the oil groove, it is possible to secure an area of the bearing which receives the maximum load, and to enhance the reliability of the rotary compressor.

According to a sixth aspect of the invention, in any one of the first to fifth aspects, a width of the oil groove provided in the bearing base portion is wider than a width of the oil groove provided in the bearing end.

According to this aspect, it is possible to amplify a pump effect caused by oil viscosity on the outlet side of the bearing end where flow of oil is reduced with respect to flow of gas, and a flow path of oil can also be secured. Therefore, it is possible to restrain the oil flow from reducing, and to provide a rotary compressor having higher reliability.

Embodiments of the present invention will be described below with reference to the drawings. The invention is not limited to the following embodiments.

Figure 2:
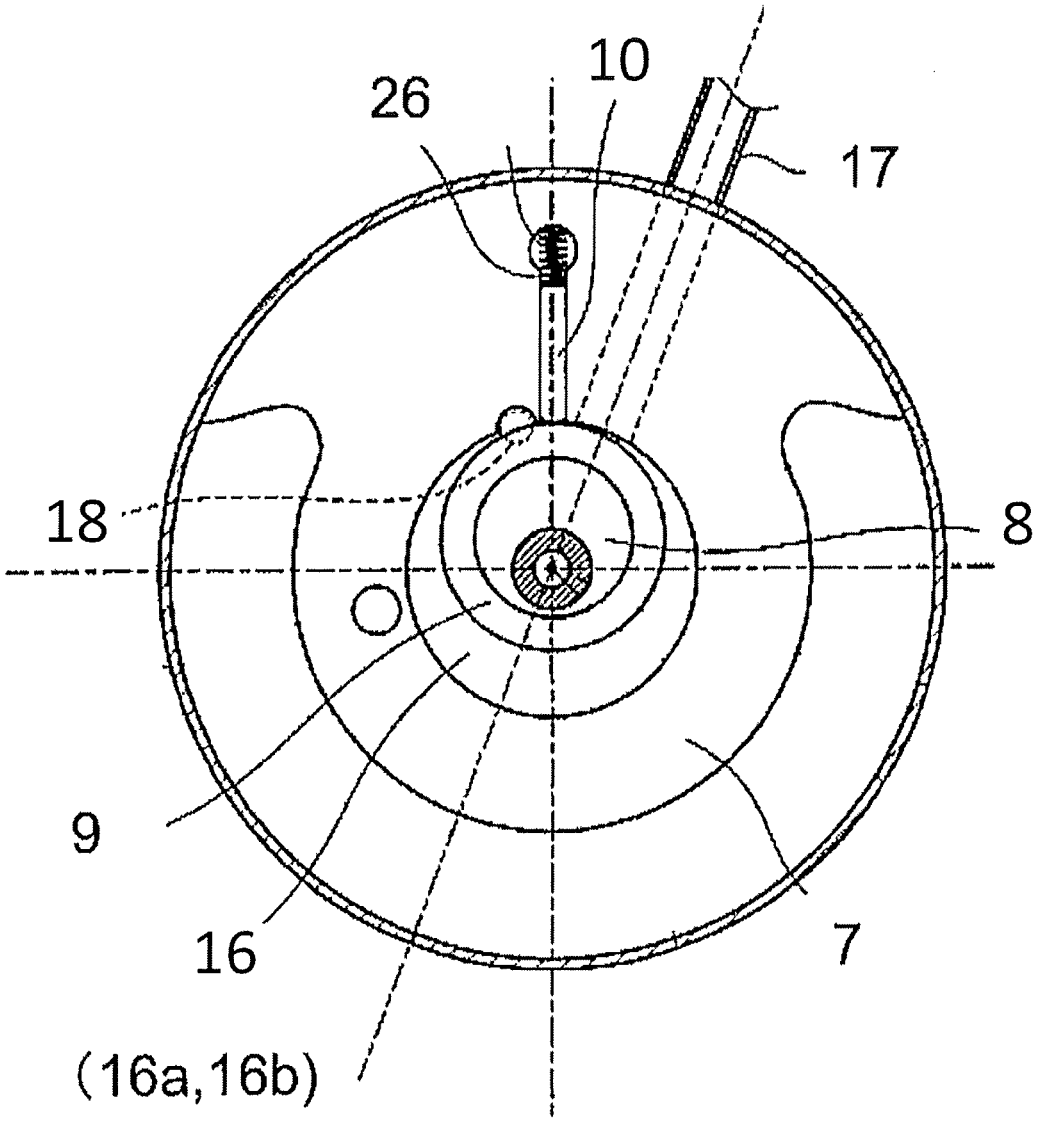
FIG. 2 is a sectional view taken along a line A-A in FIG. 1.

FIG. 1 is a vertical sectional view of a rotary compressor according to a first embodiment, and FIG. 2 is a sectional view taken along a line A-A in FIG. 1.

The rotary compressor shown in FIGS. 1 and 2 uses R32 refrigerant or refrigerant substantially composed of R32. Here, the term "substantially" means a state where refrigerant mainly composed of R32 and refrigerant such as HFO-1234yf or HFO-1234ze are mixed.

As shown in FIG. 1, according to the rotary compressor of the embodiment, an electric element 2 and a compression element 3 are accommodated in a hermetic container 1, and oil is stored in an oil reservoir 3*a* formed in a bottom of the hermetic container 1. The electric element 2 is composed of stators 4 and a rotor 5, and the compression element 3 is driven by a shaft 6 connected to the rotor 5.

The compression element 3 is composed of a cylinder 7, a piston 9, a vane 10, a main bearing 14 and an auxiliary bearing 15. The cylinder 7 is fixed to the hermetic container 1. The piston 9 is rotatably fitted over an eccentric portion 8 of the shaft 6 which penetrates the cylinder 7. The vane 10 is fitted into a vane groove 26. The vane 10 follows the piston 9 which rolls along an inner wall surface of the cylinder 7 and reciprocates the vane groove 26. The main bearing 14 and the auxiliary bearing 15 hermetically close an upper end surface 11 and a lower end surface 12 of the cylinder 7, and support the shaft 6.

The vane 10 is in contact with an outer peripheral surface of the piston 9, and partitions a compression chamber 16 in the cylinder 7 into a high pressure chamber 16*a* and a low pressure chamber 16*b*. One end of a suction pipe 17 is press fitted into the cylinder 7 to open into the low pressure chamber 16*b* of the compression chamber 16, and the other end of the suction pipe 17 is connected to a low pressure side of a system (not shown) at a location outside the hermetic container 1. A discharge valve (not shown) opens and closes a discharge hole 18 which is in communication with the high pressure chamber 16*a*. The discharge valve is accommodated in a discharge muffler (not shown) which has an opening. One end of a discharge pipe 20 opens into the hermetic container 1, and the other end thereof is connected to a high pressure side of the system (not shown).

An operation of the rotary compressor having the above-described configuration will be described below.

First, rotation of the rotor 5 is transmitted to the shaft 6. With rotation of the shaft 6, the piston 9 fitted over the eccentric portion 8 rolls in the compression chamber 16. Since the vane 10 which abuts against the piston 9 partitions the compression chamber 16 into the high pressure chamber 16*a* and the low pressure chamber 16*b*, gas sucked by the suction pipe 17 is continuously compressed. The compressed gas is released into an internal space of the hermetic container 1 through the discharge hole 18, and is discharged from the discharge pipe 20 into the system (not shown).

Figure 3:
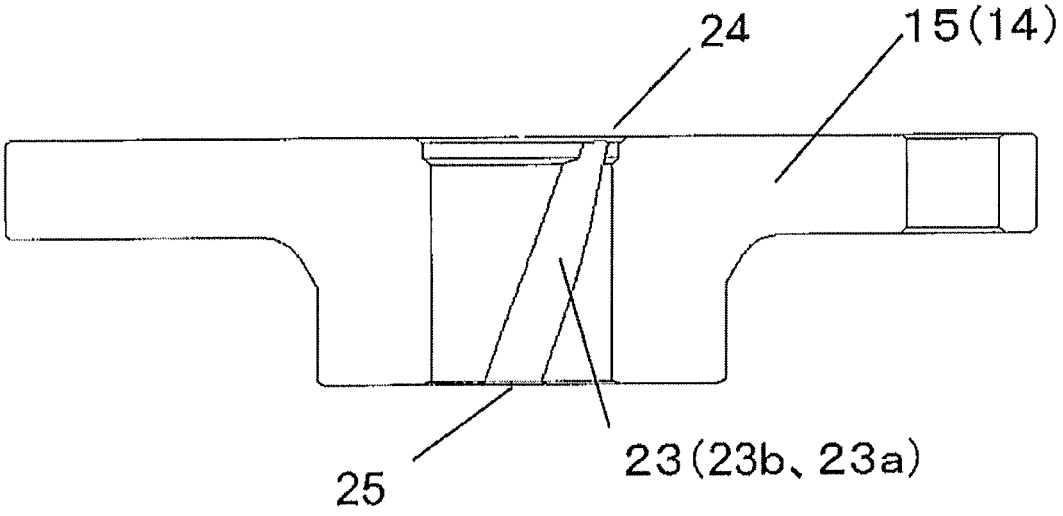
FIG. 3 is a sectional view of an auxiliary (main) bearing of the rotary compressor.

Next, the flow of oil will be described. FIG. 3 is a sectional view of the auxiliary bearing 15 (and main bearing 14) in this embodiment. A substantially spiral oil groove 23 is formed in an inner peripheral wall of a hole of each of both the bearings 15 and 14, and the shaft 6 penetrates the hole. Both ends of each of the bearings 15 and 14 open at a bearing base portion 24 and a bearing end 25.

Oil is stored in the oil reservoir 3*a* formed in the bottom of the hermetic container 1. With rotation of the shaft 6, oil is sucked from a oil-feeding hole 13 formed in a bottom of the shaft 6, and the oil is supplied to the eccentric portion 8 under an effect of a centrifugal pump by an oil panel (not shown) provided in the shaft 6. Oil is supplied to a space formed by the eccentric portion 8 and the piston 9 through a communication hole 19 provided in the eccentric portion 8. Oil is supplied to various sliding portions from a clearance between the eccentric portion 8 and the piston 9 and from a clearance between the piston 9 and each of the bearings 14 and 15, thereby lubricating the various sliding portions. Oil supplied to the space between the piston 9 and the eccentric portion 8 is sucked into the oil groove 23 of the auxiliary bearing 15 under the effect of the viscosity pump caused by the flow generated by rotation of the shaft 6, a flow from the bearing base portion 24 toward the bearing end 25 is generated and the oil is discharged. While the oil moves in the oil groove 23, the oil reaches a clearance between the shaft 6 and the auxiliary bearing 15 to lubricate the auxiliary bearing 15.

Concerning the main bearing 14 also, oil is sent upward from the bearing base portion 24 through the oil groove 23 provided in the main bearing 14, and the oil is discharged from the bearing end 25. While the oil moves through the oil groove 23, the shaft 6 and the main bearing 14 are lubricated with oil.

As described above, oil forcibly flows around the bearings 14 and 15 in the rotary compressor of this embodiment. Hence, even under refrigerant environment in which refrigerant such as R32 refrigerant is easily gasified when it is dissolved in oil, gasified gas bubbles are forcibly discharged into the hermetic container 1, gas-involvement does not occur at the bearing sliding portion, and it is possible to prevent seizing and galling from generating at the bearings 14 and 15.

A width of an oil groove 23*b* of the auxiliary bearing 15 is wider than that of an oil groove 23*a* of the main bearing 14. Therefore, following effects can be expected.

That is, since density of refrigerant gas is lower than that of oil, an upward force in the vertical direction acts on gas bubbles of refrigerant gas in oil by buoyancy. In the oil groove 23*a* of the main bearing 14, an upward flow in the vertical direction is generated as a discharging flow of oil from the compression element 3 into the hermetic container 1. Hence, since a direction of buoyancy acting on refrigerant gas and a direction of the discharging flow of oil match with each other, gas bubbles of refrigerant gas in the oil groove 23*a* of the main bearing 14 are easily discharged from the compression element 3 into the hermetic container 1.

The auxiliary bearing 15 is soaked in the oil reservoir 3*a*, a direction of the discharging flow of oil is downward in the vertical direction, and this direction is opposite from the direction of buoyancy which acts on gas bubbles of refrigerant gas. Therefore, it becomes difficult to discharge the gas bubbles of refrigerant gas from the compression element 3 into the hermetic container 1. Hence, it is possible to sufficiently secure the amount of oil supplied under the effect of the viscosity pump by increasing the width of the oil groove 23*b* of the auxiliary bearing 15, and it is possible to secure high reliability at the auxiliary bearing 15 where gas-involvement is prone to be generated by increasing the oil flow more than the main bearing 14.

Further, concerning the substantially spiral oil grooves 23*a* and 23*b* of the bearings 14 and 15, widths of the oil grooves 23*a* and 23*b* provided in the bearing base portion 24 are narrower than widths of the oil grooves 23*a* and 23*b* provided in the bearing end 25. According to this configuration, an area of the oil groove 23 is gradually increased from the bearing base portion 24 toward the bearing end 25. According to this, it is possible to continuously amplify the pump effect caused by viscosity toward the bearing end 25 with respect to the flow of gas, a flow path can also be secured and therefore, a pressure loss caused by insufficient flow path is not generated. Hence, it is possible to provide a rotary compressor having higher reliability.

Figure 4:
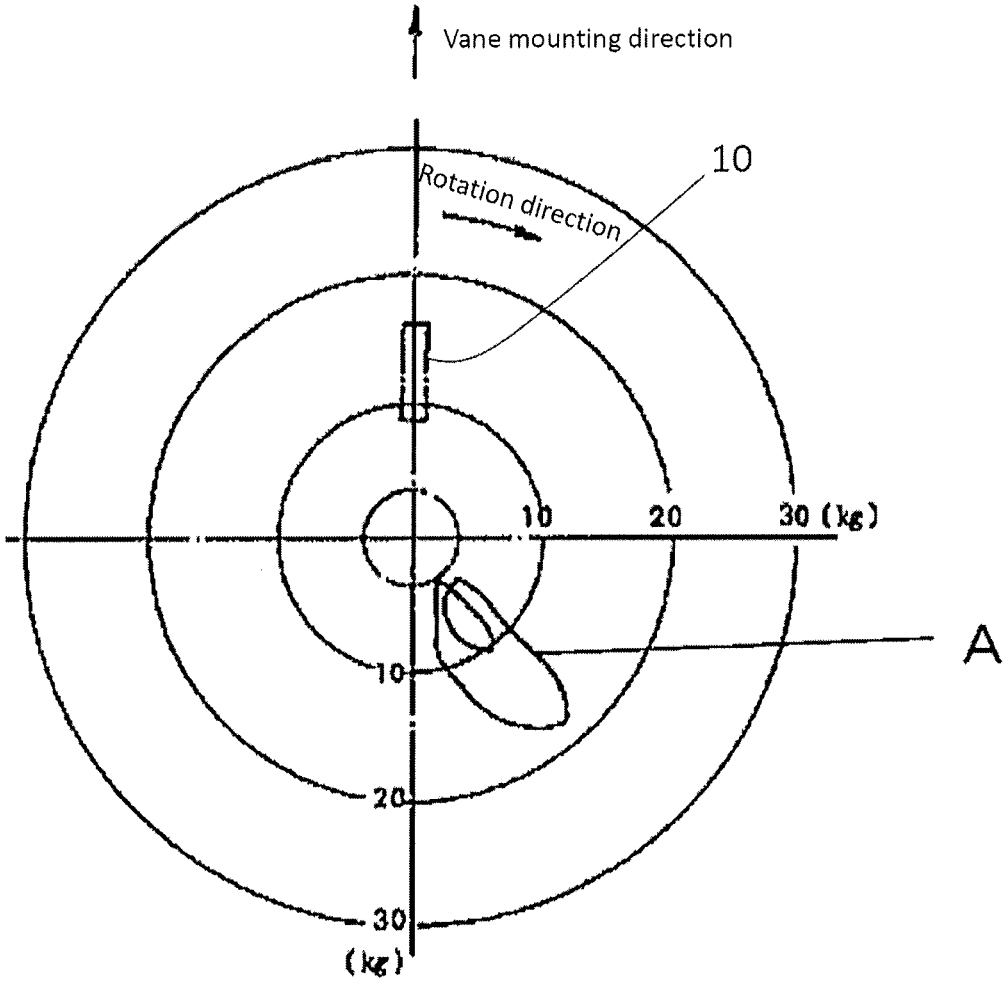
FIG. 4 is an explanatory diagram showing a locus of an axis of a shaft eccentric portion of the rotary compressor.

FIG. 4 shows a locus of an axis of the eccentric portion when the eccentric portion receives a varied load and rotates. The upward direction in FIG. 4 is a direction in which the vane 10 is mounted. It can be found in FIG. 4 that a region (portion other than axis locus A) where a load is not applied exists on the side of the bearings 14 and 15. By a load generated by compressing gas in the rotary compressor, the shaft 6 rotates eccentrically in a load direction as shown by the axis locus A with respect to centers of the bearings 14 and 15. If the oil groove 23 is provided in a place having a large load, since areas of the bearings 14 and 15 which receive the load are reduced, a surface pressure is extremely increased, and there is fear that seizing and galling of the bearings 14 and 15 are generated. Hence, if the oil groove 23 is provided in a place having a small load, it is possible to sufficiently secure a bearing area of a portion to which a load is applied, and excellent lubricating state can be obtained.

Second Embodiment

Figure 5:
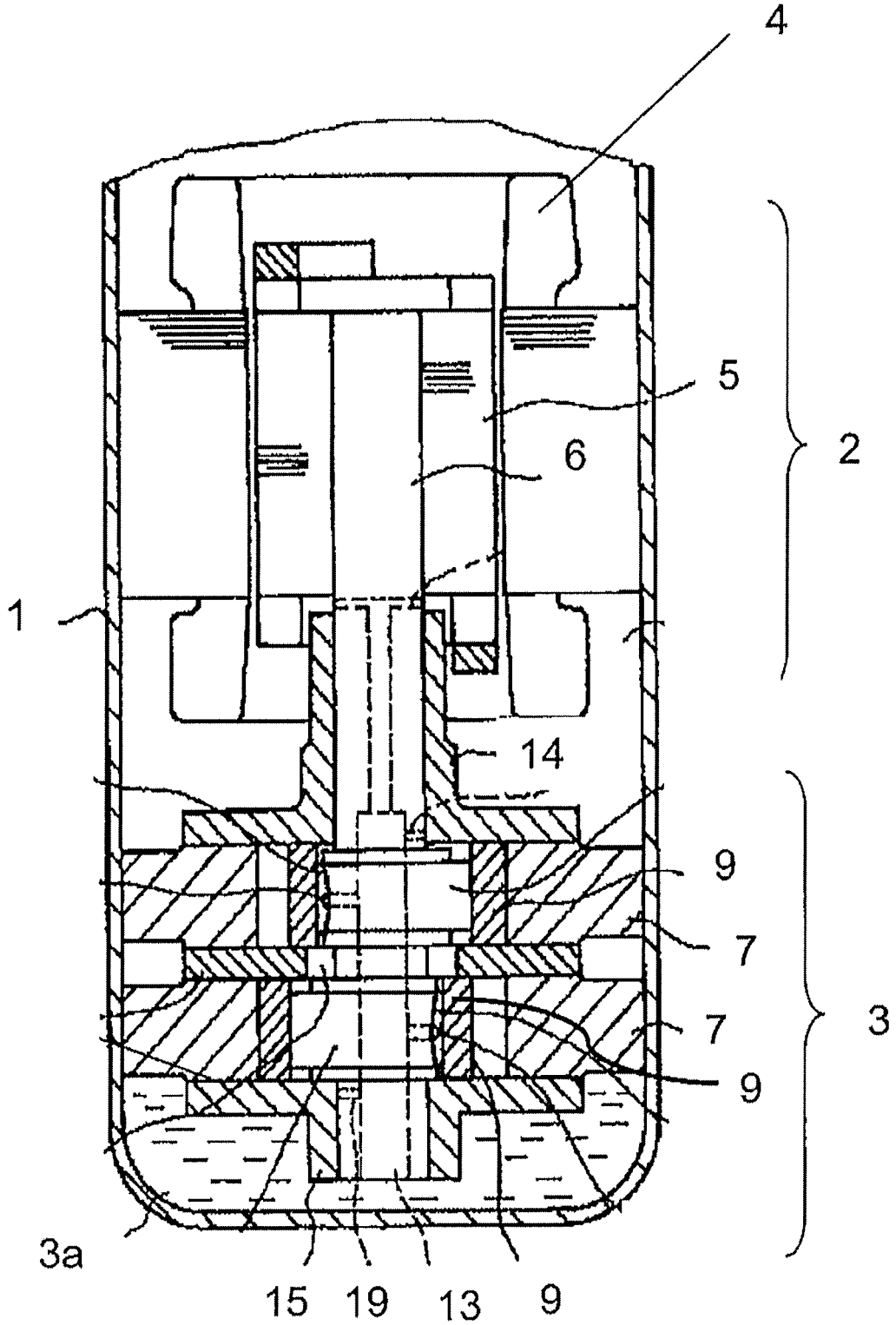
FIG. 5 is a vertical sectional view of a rotary compressor according to a second embodiment of the invention.
Figure 6:
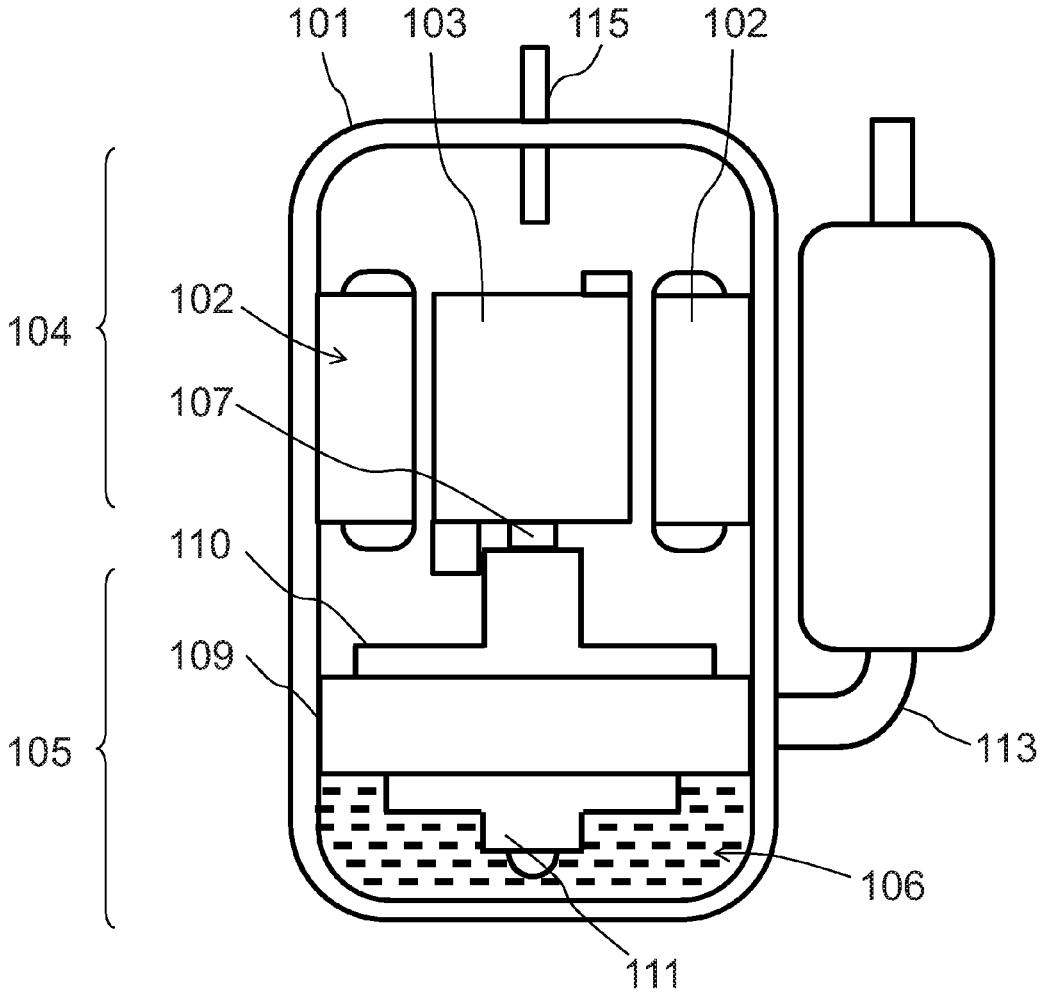
Fig. 6 Prior Art
FIG. 6 is a vertical sectional view of a conventional rotary compressor.
Figure 7:
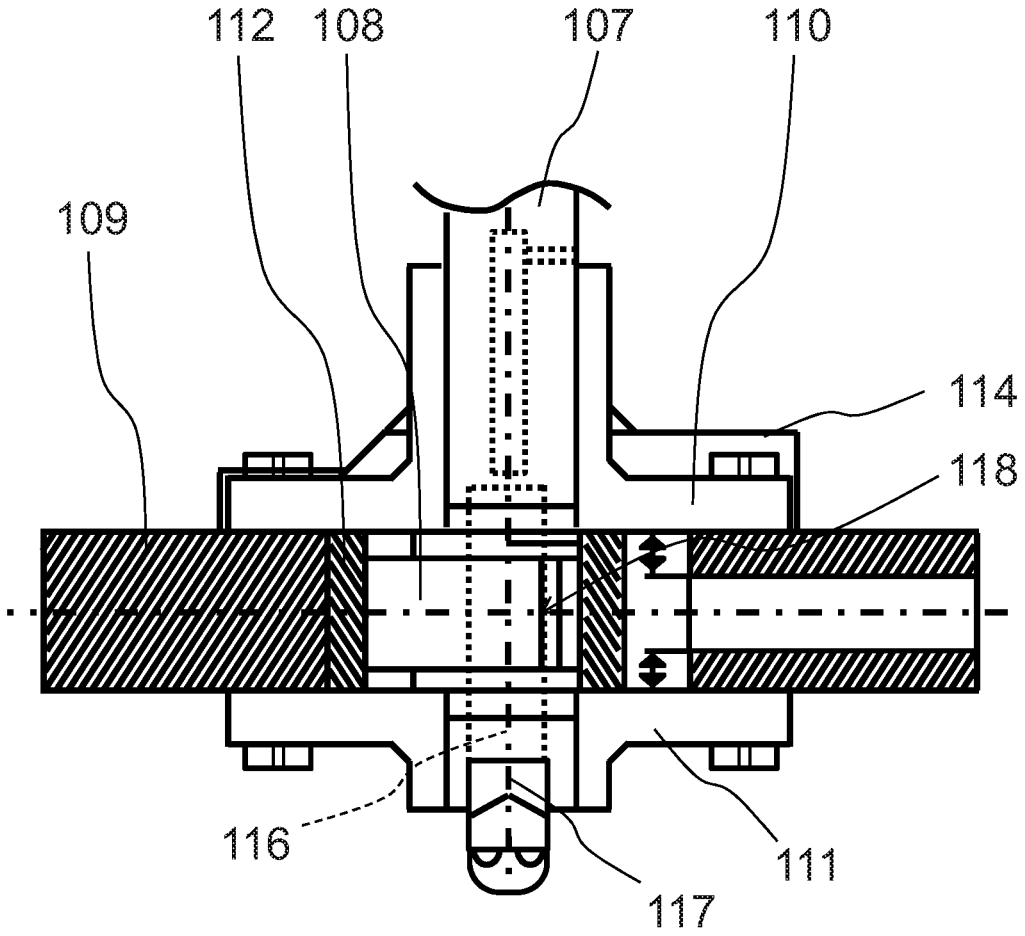
Fig. 7 Prior Art
FIG. 7 is a sectional view of a compression element of the conventional rotary compressor.

FIG. 5 is a vertical sectional view showing essential portions of a rotary compressor of a second embodiment. The same symbols are allocated to the same functional members as those of the first embodiment, and description thereof will be omitted.

The rotary compressor of the second embodiment includes a plurality of, e.g., two cylinders 7. The oil groove 23 described in the first embodiment is employed in the rotary compressor having the plurality of cylinders 7, and the same effect can be obtained.

Kinds of oil are not limited in the above embodiments.

Although the embodiments have been described based on a case where R32 refrigerant or refrigerant which is substantially composed of R32 is used, mixture refrigerant of R32 and other refrigerant may be used. For example, it is possible to use mixture refrigerant of R32 refrigerant and hydrofluoroolefin (e.g., 1234yf) having carbon-carbon double bond. The mixture refrigerant including R32 may include two or more kinds of refrigerants other than R32.

INDUSTRIAL APPLICABILITY

According to the present invention, gas bubbles generated in a sliding gap between a shaft and a bearing are forcibly discharged into a hermetic container, and it is possible to prevent seizing and wearing caused by gas-involvement at the bearing sliding portion. Hence, even if refrigerant having a low boiling point and which is easily gasified when the refrigerant is dissolved in oil is used, it is possible to secure excellent reliability. Therefore, the present invention is useful for a compressor of a refrigeration cycle apparatus which can be utilized for an electric appliance such as a water heater, a hot water heater and an air conditioner.

The invention claimed is:

1. A rotary compressor which uses refrigerant including R32, and which stores oil and a compression element in a hermetic container, wherein the compression element comprises:

a shaft having an eccentric portion;

a cylinder forming a compression chamber concentrically with a rotation center of the shaft;

a bearing which hermetically closes both side surfaces of the cylinder and which pivotally supports the shaft;

a piston which is mounted on the eccentric portion and which rolls along an inner wall of the cylinder by rotation of the shaft; and a vane which partitions the compression chamber into a high pressure chamber and a low pressure chamber, wherein an oil groove is provided in an inner peripheral surface of the bearing, and one end of the oil groove opens at a bearing base portion which is on a side of the compression chamber, and an other end of the oil groove opens at a bearing end which is on a side of a space in the hermetic container, wherein the oil groove is formed with a spiral shape in which an opening of the bearing end is located closer to a rotation direction of the shaft than an opening of the bearing base portion, the oil groove is provided at a place other than a locus of an axis of the eccentric portion when the eccentric portion rotates and receives a varied load.

2. The rotary compressor according to claim 1, wherein the bearing comprises a main bearing which closes an upper surface side of the cylinder, and an auxiliary bearing which closes a lower surface side of the cylinder, and the oil groove is provided in at least one of the main bearing and the auxiliary bearing.

3. The rotary compressor according to claim 1, wherein a width of the oil groove provided in the bearing base portion is wider than a width of the oil groove provided in the bearing end.

* * * * *